United States Patent [19]

McFarland et al.

[11] Patent Number: 4,693,413

[45] Date of Patent: Sep. 15, 1987

[54] LAMINATED BULK BIN CORNER STRUCTURE

[75] Inventors: William W. McFarland, Maryville; Russell E. Gandy, Georgetown, both of S.C.; Michael A. Churvis, Murfreesboro, Tenn.

[73] Assignee: International Paper Company, Purchase, N.Y.

[21] Appl. No.: 932,821

[22] Filed: Nov. 20, 1986

[51] Int. Cl.[4] ..... B65D 5/42

[52] U.S. Cl. ..... 229/48 R; 220/441; 229/23 R; 229/DIG. 4

[58] Field of Search ..... 220/416, 418, 441, 443; 229/23 R, 23 BT, 48 R, 485 A, DIG. 4, DIG. 2

[56] References Cited

U.S. PATENT DOCUMENTS

| | | | |
|---|---|---|---|
| 247,320 | 9/1881 | Dean | 229/43 |
| 1,154,688 | 9/1915 | Bale | 229/DIG. 4 |
| 1,288,132 | 12/1918 | Nagle | 229/DIG. 4 |
| 1,482,569 | 2/1924 | Lange | 229/DIG. 4 |
| 1,565,765 | 12/1925 | Walter | 229/23 R |
| 1,758,230 | 5/1930 | Lange | 229/DIG. 4 |
| 1,878,290 | 9/1932 | Overton | 229/DIG. 4 |
| 1,959,193 | 5/1934 | Boeye | 220/418 |
| 1,973,930 | 9/1934 | Rammer | 229/DIG. 4 |
| 1,987,225 | 1/1935 | Bergstein | 154/46 |
| 2,095,304 | 10/1937 | Zinser | 154/2 |
| 2,276,363 | 3/1942 | Zalkind | 154/52 |
| 2,382,891 | 8/1945 | McCormick | 229/37 |
| 2,558,918 | 7/1951 | Zinn, Jr. | 229/DIG. 4 |
| 2,770,406 | 11/1956 | Lane | 229/3.5 |
| 2,791,369 | 5/1957 | Paige | 220/418 |
| 2,949,151 | 8/1960 | Goldstein | 229/DIG. 4 |
| 3,122,350 | 2/1964 | Labrasa | 220/418 |
| 3,659,772 | 5/1972 | Dorsey | 229/3.1 |
| 3,746,593 | 7/1973 | Majewski | 229/DIG. 4 |
| 4,268,555 | 5/1981 | Kantz | 229/DIG. 4 |
| 4,504,497 | 3/1985 | Kurth et al. | 229/DIG. 4 |
| 4,526,314 | 7/1985 | Reil | 229/DIG. 4 |
| 4,635,815 | 1/1987 | Grigsby | 229/DIG. 4 |

*Primary Examiner*—Stephen Marcus
*Assistant Examiner*—Gary E. Elkins
*Attorney, Agent, or Firm*—Walt Thomas Zielinski

[57] ABSTRACT

A corner fold structure for a paperboard bin. Large bulk bins formed of layers of corrugated paperboard laminated together, often are manufactured with a pair of 180 degree folds, the folds permitting shipment of the bins in a collapsed condition prior to (individually) erecting them. After erection, at least one of the layers or plys of corrugated paperboard, at or adjacent the original 180 degree fold, now being a 90 degree fold, is often distorted, the fold sometimes bulging at the outer portion of the outermost ply or layer. According to this invention, an elongated zone of adhesive is provided between the outermost and the next layer of corrugated paperboard, in combination with score lines adjacent to and parallel with the line of adhesive. This line of adhesive is substantially parallel with the fold line or axis of the 180 degree fold. By such adhering together of the outermost and next layer or ply along this zone, the final 90 degree fold exhibits substantial uniformity therealong. This results in both improved appearance and strength of the bulk bin.

4 Claims, 7 Drawing Figures

FIG. 4
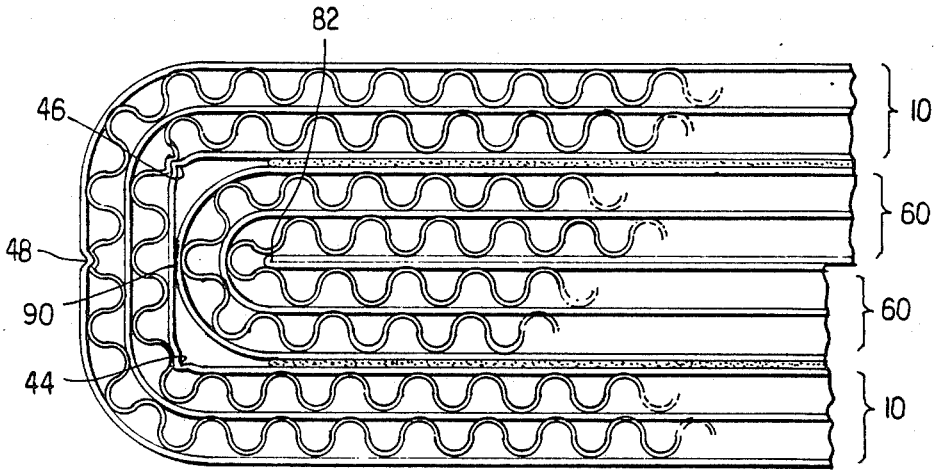
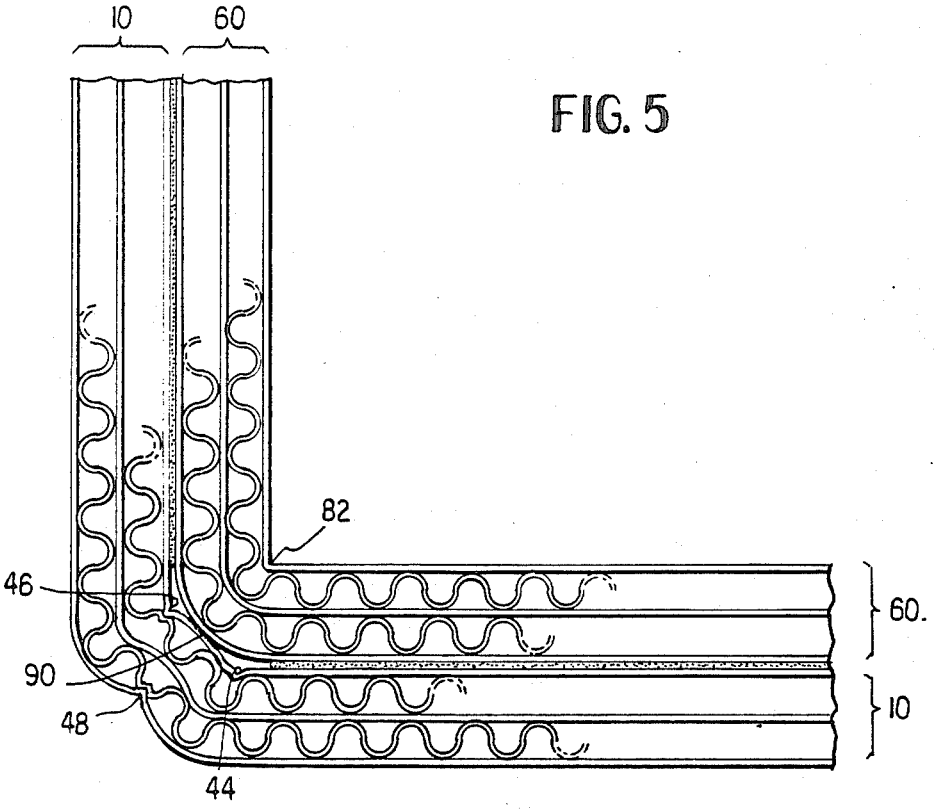
FIG. 5

LAMINATED BULK BIN CORNER STRUCTURE

BACKGROUND OF THE INVENTION

This invention relates to large bulk containers or bins which are fashioned from multiplys of laminated materials, such as two or more plys or layers of corrugated paperboard. Large bulk containers are often formed from a generally rectangular blank, usually flat, which has been suitably scored and crushed, by foldong certain panels of the blank and then joining the ends of the blank to form a flattened tube structure. After the formation of the blank into a collapsed tube by joining its opposite ends, the packager or final user of the bulk bin then unfolds or erects the flattened tube structure into its expanded, tubular condition or configuration, to thereby form a bulk bin of generally rectangular configuration.

Along those portions of the bulk bin which are to be folded 180 degrees (often termed a reverse fold) in passing from the original, planar blank to the collapsed or knocked down tube, there is, in prior art bulk bins of this type, a distortion and build-up of the paperboard material at these vertically extending edges of the bulk bin, where the 180 degree folds become 90 degree folds or edges upon refolding 90 degrees attendant set-up or erection. The strength of the erected container is diminished by this irregular bulging or distortion and the appearance of the container at these folds is also marred.

SUMMARY OF THE INVENTION

According to the practice of this invention, each of the two 90 degree fold forming corners of an erected bulk bin, formed by the partial unfolding of a respective 180 degree fold, is formed in such a way as to control the movement of the several layers of paperboard of the corrugated paperboard laminate at these corners or edges. This yields maximum strength when the box or bin is erected and improves the appearance of these corners. This control of the paperboard layers at these folds areas is effected by a novel combination of score lines and a glue line. The outer corrugated paperboard layer is provided with double score lines on its interior fold forming portion and with a single score line, adjacent to this fold, on its exterior surface portion. The next or interior corrugated layer is provided with a single score line on its bin interior surface. The 180 degree fold portions of each of the corrugated paperboard layers are partially crushed, on one side, while the blank is still flat, with adjacent, interface facing portions of the paperboard layers being glued together. When folded 180 degrees and then partially unfolded 90 degrees to assume the set up or erected 90 degree position, there is no random separation, bulging or distortion along these corners or edges. The invention may be carried out with two, three or four ply or layer corrugated paperboard structures.

BRIEF DESCRIPTION OF THE DRAWINGS

FIG. 4 is a view showing the laminate of FIG. 3 after it has been bent 180 degrees, for shipment of the collapsed bulk bin.

FIG. 5 is a view showing the fold of FIG. 4 after it has been refolded to a 90 degree position, thus showing the fold of this invention when the bulk bin is in its erected position.

DETAILED DESCRIPTION OF THE INVENTION

Figure 1:
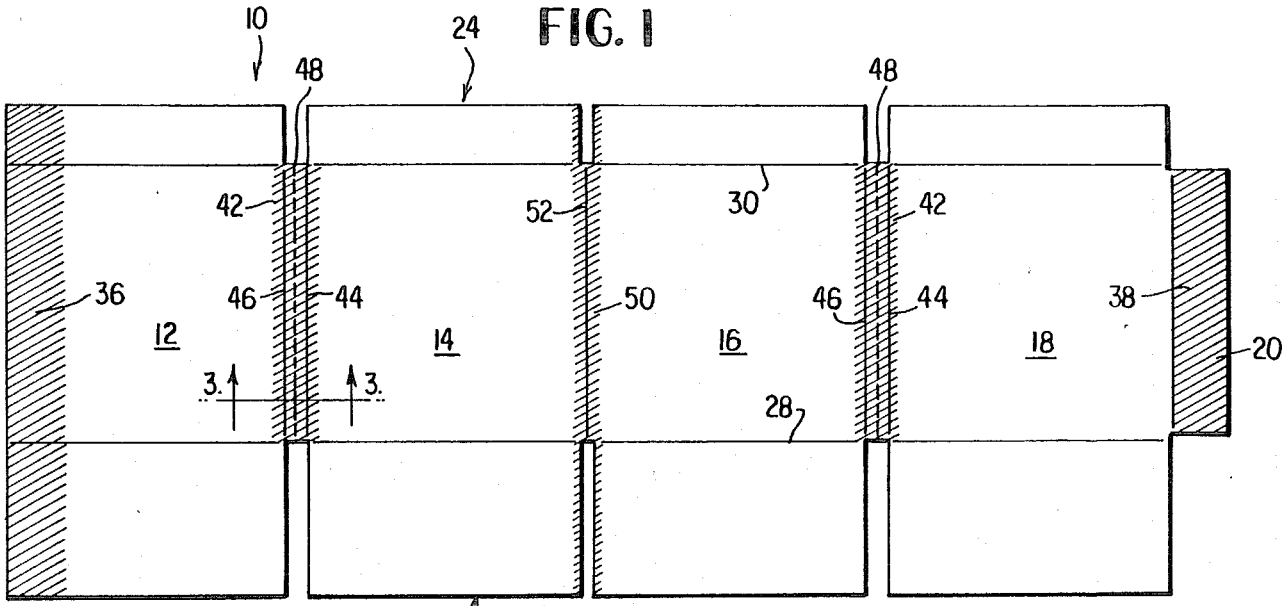
FIG. 1 is a plan view of a corrugated paperboard blank, with the bin exterior surface thereof facing away from the reader, the blank adapted to form the outermost layer of a two or more ply or layer bulk bin container.

Referring now to FIG. 1 of the drawings, the numeral 10 denotes a generally rectangular blank fashioned from a single piece of corrugated paperboard, the blank adapted to form the outside layer of a two layer bulk bin. The blank includes serially, longitudinally arranged sidewall forming panels 12, 14, 16, and 18 and a manufacturer's tab 20. The numeral 22 denotes generally a plurality of container bottom forming panels, while the numeral 24 denotes generally a plurality of upper panels, panels 22 and 24 being attached, respectively, to respective ones of the sidewall forming panels and being foldable along score lines 28 and 30, respectively. The numeral 36 denotes a crush area, denoted also by hatched lines, along the left edge of blank 10 as viewed in FIG. 1, while the numeral 38 denotes a corresponding crush area on manufacturer's tab 20.

The numeral 42 indicates crush areas extending along those transverse fold lines of the blank which are adapted to be folded 180 degrees. These areas are on the side of the blank away from the reader. The numerals 44 and 46 denote parallel score lines on that blank surface facing the reader. The numeral 48 denotes a score line, shown as dashed, intermediate score lines 44 and 46, score line 48 being on the opposite side of the blank, away from the reader. The numeral 50 denotes a crush zone along a transverse fold axis 52 between panels 14 and 16.

Figure 2:
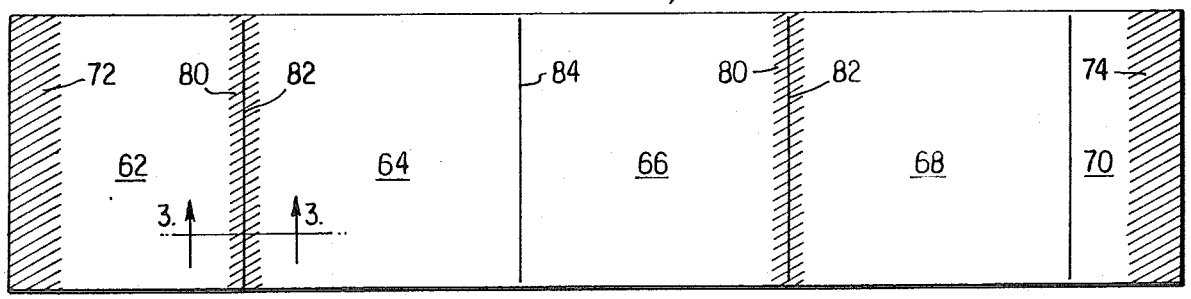
FIG. 2 is a plan view of a similar blank, also fashioned from corrugated paperboard which is to form the innermost ply or layer of a two ply bulk bin container. That surface of the blank which is to form the inside of the container faces the reader.

Referring now to FIG. 2 of the drawings, the numeral 60 denotes a generally rectangular blank, also fashioned from corrugated paperboard, and includes a plurality of serially and longitudinally arranged panels 62, 64, 66, and 68, with the latter panel carrying manufacturer's tab 70. The numeral 72 denotes a crush area at the left edge of blank 60, as viewed at FIG. 2, while the numeral 74 denotes a crush area on the right edge of manufacturer's tab 70. The numerals 80 denote crush areas along respective transverse fold lines 82, lines 82 being adapted to be folded 180 degrees. The numeral 84 denotes a transverse fold line, parallel to lines 82, between panels 64 and 66. Crush areas 80 are on that surface of blank 60 facing the reader, being adapted to form the inner surface of the bulk box.

In forming the double layer laminate according to this embodiment of the invention, an adhesive is spread over either that surface of blank 10 between score lines 30 and 28, facing the reader, or that surface of blank 60 facing away from the reader, with these blanks then being placed together in overlapping, superposed surface contact relationship. The arrangement is such that the left end of blank 10 is aligned with the left end of blank 60. After pressing blanks 10 and 60 together, the final laminate is formed, and is also planar. As the next step in forming the knocked down bulk container of this invention, aligned and superposed panels 12 and 62 are folded over towards the center of the laminate, while superposed panels 18 and 68, at the opposite end, are also folded toward the center. This is accomplished by bending 90 degrees along each of the left set of fold lines 44 and 46, for a total of 180 degrees, so that panels 12,62 and 14,64 overlap and by bending 90 degrees along each of the right set of fold lines 44 and 46, for a total of 180 degrees, so that panels 18,68 and 16,66 overlap. Then, the manufacturer's flaps 20,70 are glued to the left hand of panels 12,62. The container now is ready for shipment and subsequent erection to form a completed container ready for loading.

Figure 3:
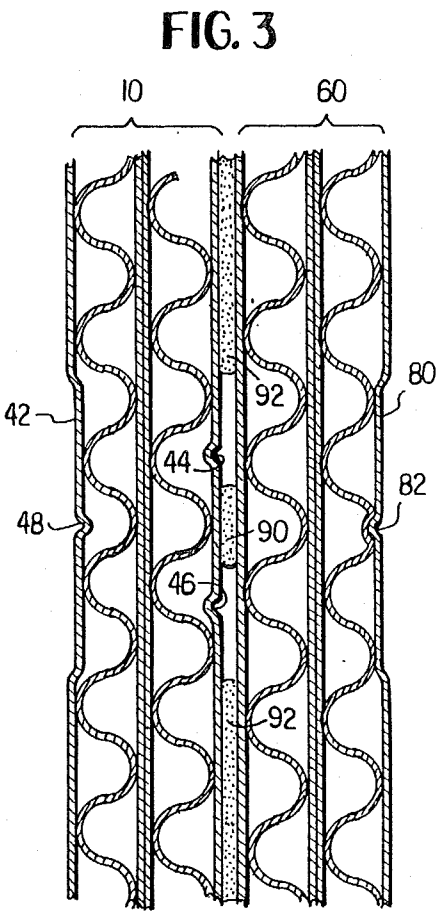
FIG. 3 is transverse cross sectional view along a two layer laminate defined by placing the blanks of FIGS. 1 and 2 together and gluing them, the view being taken along one of the 180 degree fold forming corners or lines, the view showing this portion of the laminate before it is folded 180 degrees.

Referring now to FIG. 3 of the drawings, a transverse cross section of one of the 180 degree fold forming areas, corresponding to the portion 3—3 of FIGS. 1 and 2, illustrated. The double ply laminate, with each layer defined by a corrugated paperboard layer, is shown prior to its 180 degree fold. FIG. 3 also shows a glue attachment zone or strip which is defined along a longitudinal zone or portion of paperboard layer 10, between its scores 44 and 46, with a corresponding zone on paperboard layer 60, this attachment strip being denoted by the numeral 90. Strip 90 is opposite score 82 of the innermost layer 60. The adhesive joining the main areas of layers 10 and 60 is denoted by the numeral 92. The adhesive 90 has been shown as a separate strip, apart and distinct from the remainder of the adhesive 92. In practice, strip 90 may be an integral part or zone of an entire layer of adhesive 92. For convenience in description, the glued together surfaces of the two corrugated paperboard layers is termed a common interface surface, with the other or outer surfaces, being the leftmost and the rightmost surfaces of FIG. 3, termed non common interface surfaces. Partially crushed zone 42 is seen to extend laterally of score line 48, while partially crushed zone 80 is seen to extend laterally of score line 82, this also being shown at FIG. 1.

Referring now to FIG. 4, the laminate fold area shown at FIG. 3 has been folded 180 degrees.

Referring now to FIG. 5, the corner or edge fold of FIG. 4 has been opened to a 90 degree position, corresponding to the erected or set up configuration of the bulk bin container. The glue strip 90, in combination with scores 44, 46, 48 and 82, controls the components of the two layers 10 and 60 to thereby prevent bulging at each of the two 90 degree fold portions adjacent scores 44 and 46. The reader will observe that a W shape configuration is formed, this configuration controling the displacement of the several portions of the paperboard forming the joint with the result that there is no distortion at the 90 degree joint between adjacent side panels of the bin.

Figure 6:
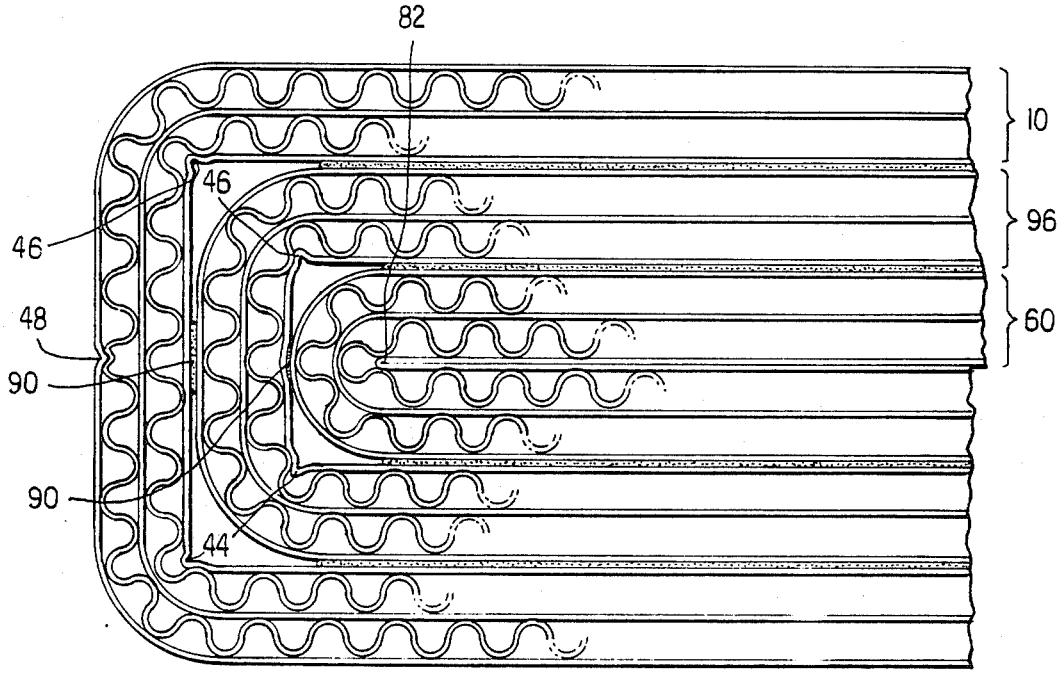
FIG. 6 is a view similar to FIG. 4, and shows an embodiment having an additional layer of corrugated paperboard and which forms a three ply bulk bin container.
Figure 7:
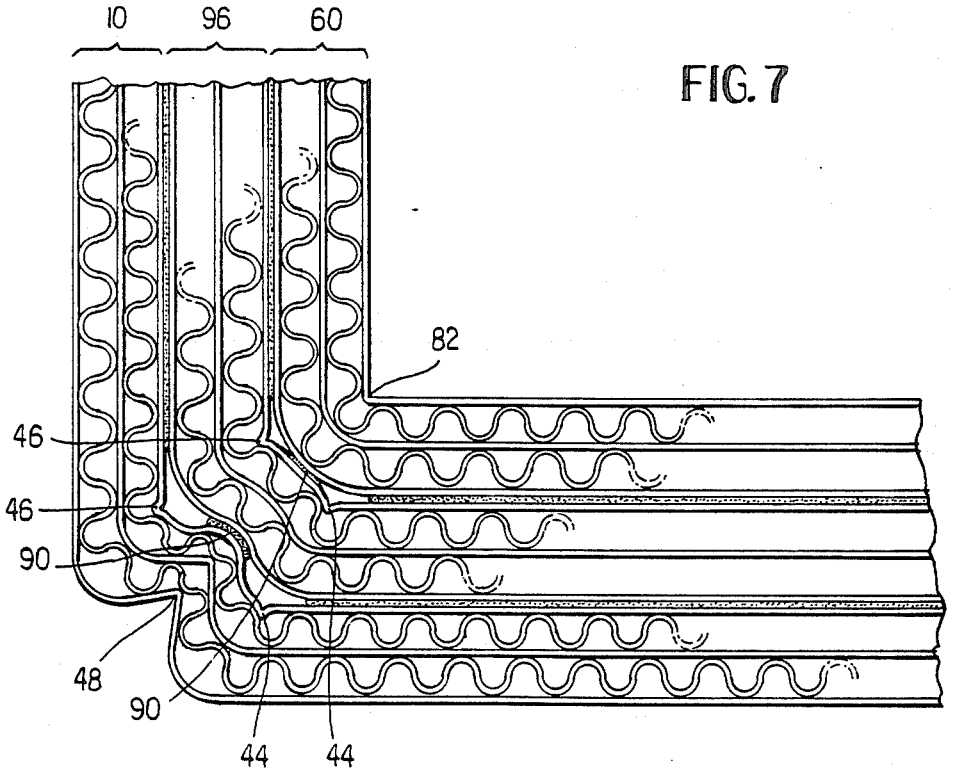
FIG. 7 is a view similar to FIG. 5, and shows the 180 degree folded joint of FIG. 6 after it has been refolded to a 90 degree position, corresponding to the erected position of the bulk bin.

Referring now to FIGS. 6 and 7 of the drawings, a corrugated paperboard laminate is shown with a third corrugated paperboard layer, denoted by the numeral 96, interposed between layers 10 and 60. The 180 degree folded configuration of this embodiment is shown at FIG. 6 and corresponds to FIG. 4 of the two layer embodiment previously described. FIG. 7 illustrates the partially unfolded (refolded 90 degrees) configuration of this three layer embodiment and corresponds to FIG. 5. Each of the two outermoast layers 10 and 96 folds 90 degrees at respective scores 44,46 to reach the 180 fold position shown at FIG. 6. The manner of formation and of operation of the embodiment of FIGS. 6 and 7 will otherwise be apparent from the description previously set forth.

We claim:

1. A paperboard laminate for forming a bulk bin by folding the laminate, the laminate being planar and adapted to be folded 180 degrees and then to be refolded back 90 degrees to a 90 degree position from its original, planar form, the laminate including a first, bulk bin exterior forming corrugated paperboard layer and a next adjacent corrugated paperboard layer, a common interface surface between said first and second corrugated paperboard layers, said first layer having on its said interface surface a pair of parallel score lines, a score line located substantially midway between said first mentioned pair of score lines and located on the non common interface surface of said first layer, said score lines all being parallel to each other, said second layer being overlapped and adhered to said first layer, the common interface surface of said second layer being adhered, along an attachment strip thereof, to a corresponding attachment strip on the common interface surface of the first layer, said strip being substantially midway between said first mentioned pair of parallel score lines, whereby a 180 degree fold is formed by folding 90 degrees along each of said parellel lines on the common interface surface of said first layer and whereby upon refolding the 180 degree fold back 90 degrees, the several components of the corrugated paperboard layers do not become distorted and therefore retain their strength and uniform appearance at the refolded, 90 degree position.

2. The laminate of claim 1 wherein the non common interface surface of said second layer is provided with a score line parallel to said other score lines and located substantially midway of said pair of score lines on the interface surface of said first layer.

3. The laminate of claim 2 wherein that non common interface surface of said first corrugated paperboard layer laterally of its score line is partially crushed towards the common interface surface.

4. The laminate of claim 2 wherein that non common interface surface of said second corrugated paperboard layer laterally of its score line is partially crushed towards the common interface surface.

* * * * *